US009972293B1

(12) United States Patent
Keller

(10) Patent No.: US 9,972,293 B1
(45) Date of Patent: May 15, 2018

(54) MODULAR PORTABLE RISER APPARATUS

(71) Applicant: Kent Edward Keller, Sequim, WA (US)

(72) Inventor: Kent Edward Keller, Sequim, WA (US)

( * ) Notice: Subject to any disclaimer, the term of this patent is extended or adjusted under 35 U.S.C. 154(b) by 0 days. days.

(21) Appl. No.: 15/637,173

(22) Filed: Jun. 29, 2017

(51) Int. Cl.
*G10D 13/02* (2006.01)
*G10G 5/00* (2006.01)

(52) U.S. Cl.
CPC ..... *G10D 13/026* (2013.01); *G10G 5/005* (2013.01); *G10D 13/02* (2013.01); *G10G 5/00* (2013.01)

(58) Field of Classification Search
CPC ..... G10D 13/026; G10D 13/02; G10G 5/005; G10G 5/00
USPC ..... 84/421
See application file for complete search history.

(56) References Cited

U.S. PATENT DOCUMENTS 373,873 A * 11/1887 Wurlitzer ..... G10D 13/026 84/421
516,612 A * 3/1894 Rappold ..... G10D 13/006 84/421
1,022,149 A * 4/1912 Maphet ..... G10D 13/026 248/166
3,659,032 A * 4/1972 May ..... G10H 5/00 84/600
4,240,646 A * 12/1980 Scott ..... B62B 3/02 16/34
4,457,202 A * 7/1984 DeBarbrie ..... G10D 13/02 84/411 R
4,579,229 A * 4/1986 Porcaro ..... G10G 5/00 108/53.5
4,580,776 A * 4/1986 Burkinshaw ..... E04B 1/3445 108/166
4,691,611 A * 9/1987 May ..... G10D 13/024 84/421
4,779,542 A * 10/1988 Staten ..... A47B 25/003 108/170
4,829,874 A * 5/1989 Hoshino ..... G10D 13/026 84/421
5,161,761 A * 11/1992 May ..... G10H 1/32 248/122.1
5,520,292 A * 5/1996 Lombardi ..... A47F 7/00 211/182
5,531,148 A * 7/1996 Wilson ..... G10D 13/024 84/412
5,613,450 A * 3/1997 Wagner ..... E04H 3/28 108/170
5,744,738 A * 4/1998 Gatzen ..... G10D 13/00 248/124.1
D396,008 S * 7/1998 Hay ..... D9/455
5,977,464 A * 11/1999 Bencomo, Jr. ..... G10D 13/026 84/421
5,994,634 A * 11/1999 Cady ..... G10D 13/00 84/421

(Continued)

FOREIGN PATENT DOCUMENTS

GB 2327187 A * 1/1999 ..... E04G 1/28

*Primary Examiner* — David Warren
*Assistant Examiner* — Christina Schreiber

(57) ABSTRACT

The Kit Lift is a method of and a portable, modular, light weight apparatus for elevating a drum set and drummer for performances by only supporting the essential elements of the drum set, including the kick drum front support arms, the kick drum pedal(s), hi-hat stand feet and hi-hat pedal, without increasing the stage footprint requirement.

11 Claims, 11 Drawing Sheets

(56) References Cited

U.S. PATENT DOCUMENTS 6,471,078 B2 * 10/2002 Pyle ..... G10D 13/00 211/85.6
6,610,916 B1 * 8/2003 Torrez ..... F16M 13/02 84/421
7,208,667 B2 * 4/2007 Morgan ..... G10D 13/08 84/421
7,576,275 B2 * 8/2009 Dixson, Jr. ..... G10D 13/026 84/421
7,928,304 B2 * 4/2011 Eason ..... F16B 7/0486 84/412
8,088,984 B2 * 1/2012 Meyer ..... B62B 3/02 84/421
8,167,148 B2 * 5/2012 Jacobson ..... A47B 81/00 108/193
8,513,509 B2 * 8/2013 Ramirez ..... G10D 13/00 84/421
8,723,008 B1 * 5/2014 Darnell ..... G10D 13/026 84/421
9,318,084 B2 * 4/2016 Lafrenz ..... G10D 13/026
9,697,811 B1 * 7/2017 Meliti ..... G10D 13/026
2004/0112197 A1 * 6/2004 Morgan ..... G10D 13/08 84/327
2005/0011135 A1 * 1/2005 Hallberg ..... E04H 3/28 52/7
2005/0268772 A1 * 12/2005 Schaff ..... G10D 13/00 84/421
2006/0005689 A1 * 1/2006 Ito ..... G10D 13/006 84/422.1
2006/0131251 A1 * 6/2006 Stadler ..... E04B 1/8236 211/85.6
2008/0289476 A1 * 11/2008 Dixson, Jr. ..... G10D 13/026 84/421
2010/0043622 A1 * 2/2010 Sandson ..... G10D 13/00 84/421
2010/0107854 A1 * 5/2010 Dixson, Jr. ..... G10D 13/026 84/421
2011/0259175 A1 * 10/2011 Mollick ..... G10D 13/02 84/421
2012/0073421 A1 * 3/2012 Ramirez ..... G10D 13/00 84/421
2013/0074676 A1 * 3/2013 Waitzman, III ..... G10D 13/00 84/421
2014/0090541 A1 * 4/2014 Sato ..... G10D 13/026 84/421
2016/0091134 A1 * 3/2016 May ..... F16M 11/28 248/404
2017/0140744 A1 * 5/2017 Kreifeldt ..... G10H 1/348
2017/0169803 A1 * 6/2017 Pinelli ..... G10D 13/00
2017/0243572 A1 * 8/2017 Trifilio ..... G10H 1/348

* cited by examiner

LATITUDINAL KICK SUPPORT

LONGITUDINAL KICK SUPPORT

KICK PEDAL STABILIZER

LATITUDINAL HI-HAT SUPPORT

LONGITUDINAL HI-HAT SUPPORT

MODULAR PORTABLE RISER APPARATUS

FIELD OF THE INVENTION

The invention relates to a portable drum set riser for professional drummers.

BACKGROUND OF THE INVENTION

In professional music concert settings, drummers are typically situated in a sitting position in the back of the music group while other performers, usually the featured performers, are placed in front in a standing position. The drummer's position distanced from the audience limits visibility of the drummer, thereby hindering the audience's experience and limiting the drummer's ability to engage with his or her audience.

This problem is typically solved by placing the drummer on a dedicated riser, normally 6 to 24 inches in height. Such dedicated risers work well for large shows on large stages, but are not feasible to use in smaller settings or on small stages. Dedicated risers in smaller settings increase the footprint of the drum set in a setting in which stage space is limited. Furthermore, drum risers are large and heavy requiring large vehicles, extra personal, and extra time to deploy and recover. Due to these limitations, use of a dedicated riser is insurmountable for smaller venues. As a result, drummers are resigned to setting the drum set up directly at the stage level. In addition, cables for microphones and other audio and lighting equipment are typically routed to the back area of the stage, directly past the drummer. Routing cables under a large drum riser is time consuming and often results in equipment damage as cables may tangle underneath the riser making recovery especially difficult.

Accordingly, there is an unmet need in the art for a smaller, portable riser that elevates both the drum set and the drum player while overcoming the limitations of size, weight and time requirements for dedicated risers, and which enhances, rather than detracts from, the experience of the concert performance.

THE INVENTION

Summary of the Invention

The Modular Portable Riser Apparatus (also referred to herein as the Kit lift) of this application is an apparatus capable of lifting only the elements of the drum set and player that need to be lifted without increasing the stage footprint requirement.

BRIEF DESCRIPTION OF THE DRAWINGS

The Modular Portable Riser Apparatus is described in more detail with reference to the attached drawings, in which.

DETAILED DESCRIPTION

Figure 7:
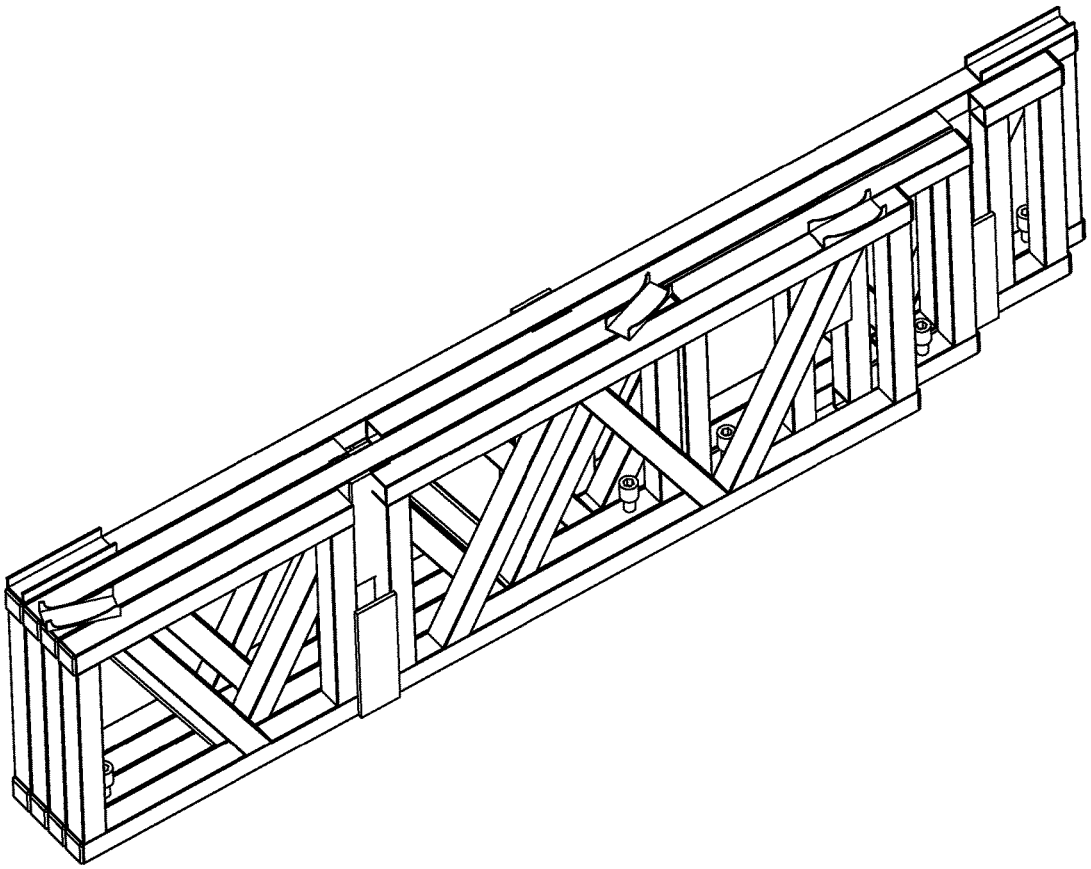
FIG. 7 is a drawing showing the Kit lift in its travel configuration.
Figure 8:
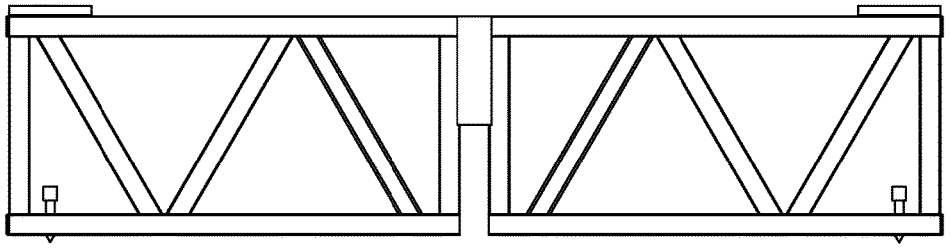
FIG. 8 is a drawing showing the major components of the modular Kit lift laid out before assembly.
Figure 8:
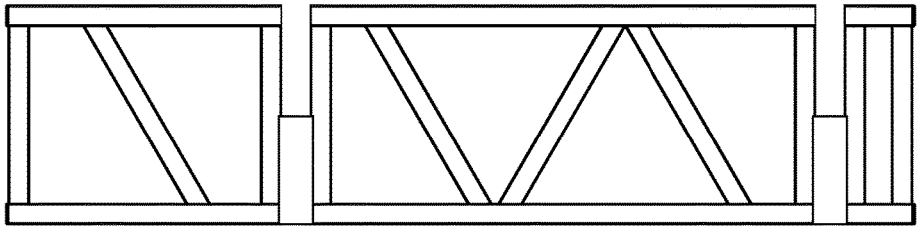
Figure 8:
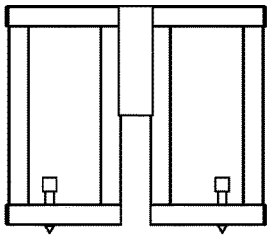
Figure 8:
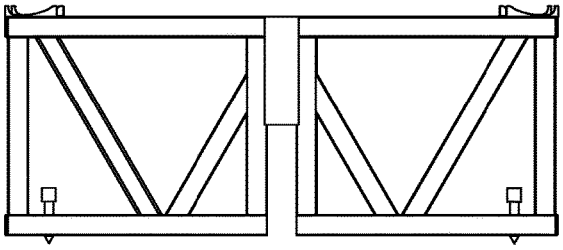
Figure 8:
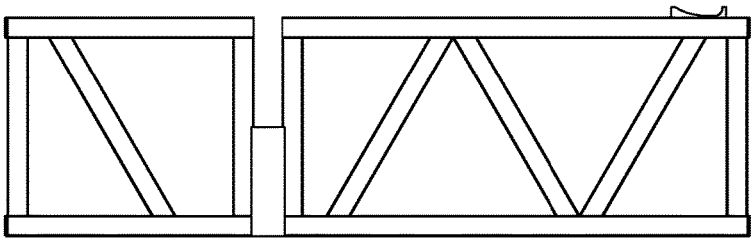
Figure 9:
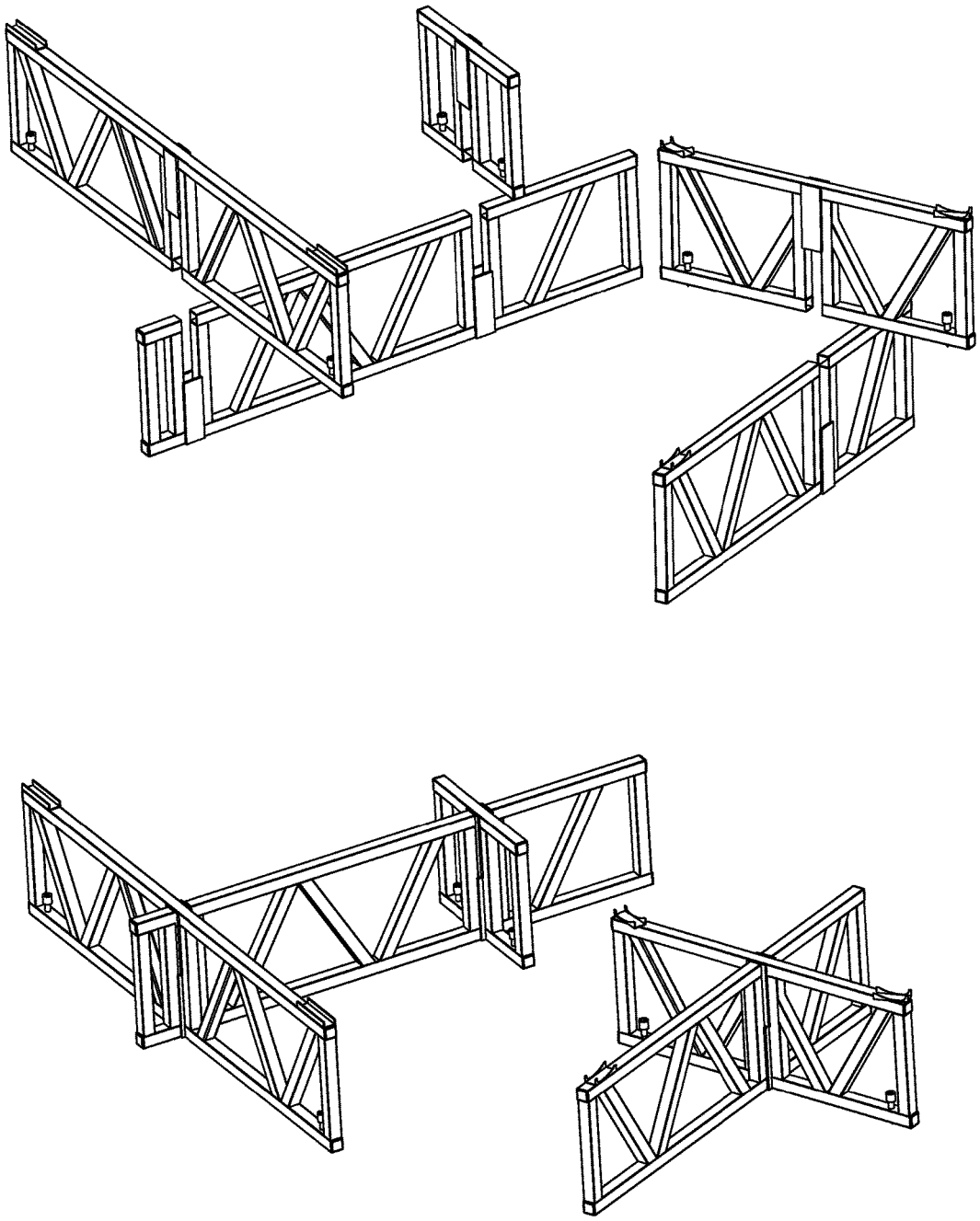
FIG. 9 is a drawing showing how the Kick Lift and Hat Lift assemblies are put in place to form the Kit lift.
Figure 10:
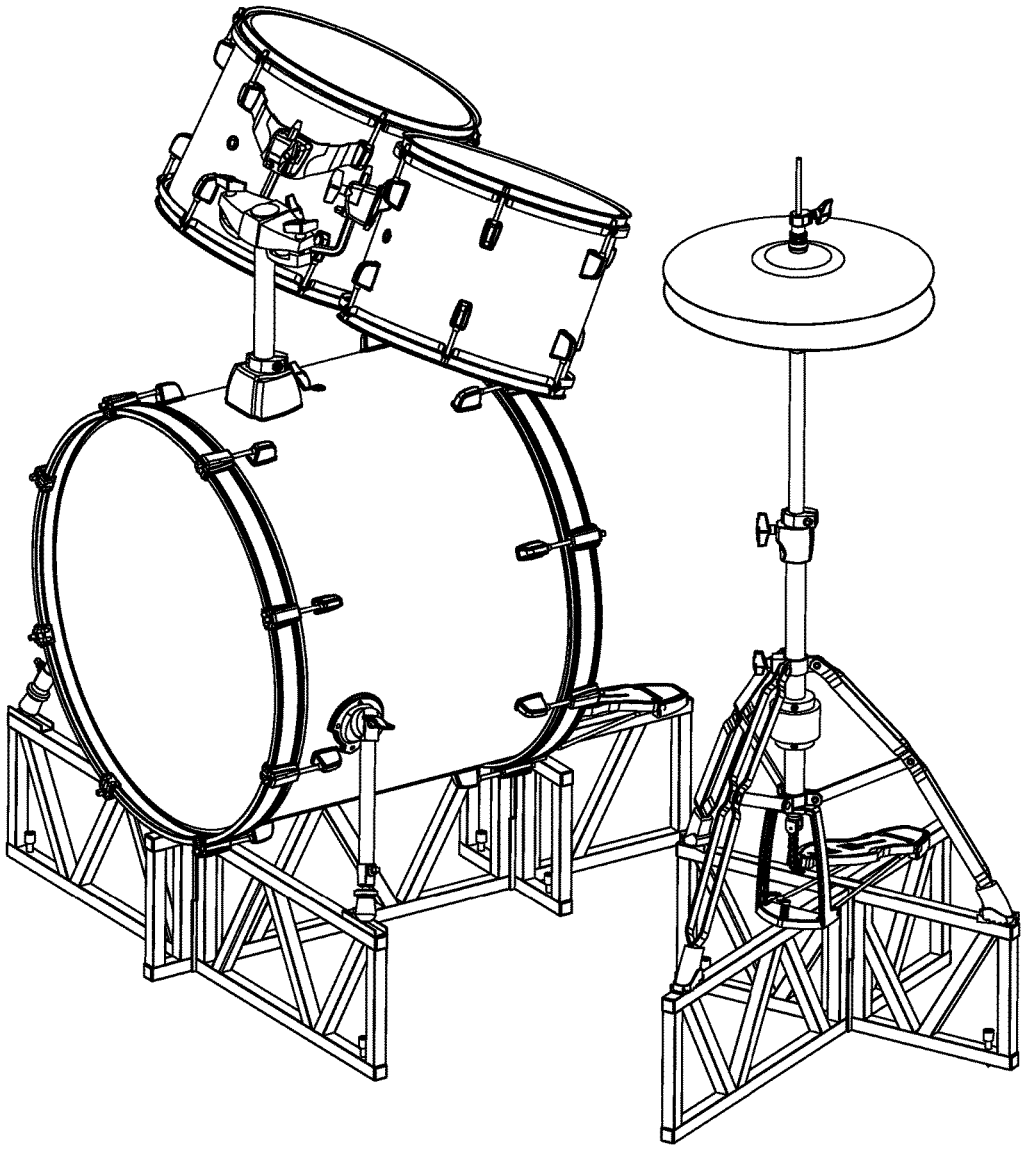
FIG. 10 is a drawing showing the Kick Drum and Hi-Hat mounted upon the Kit lift.
Figure 11:
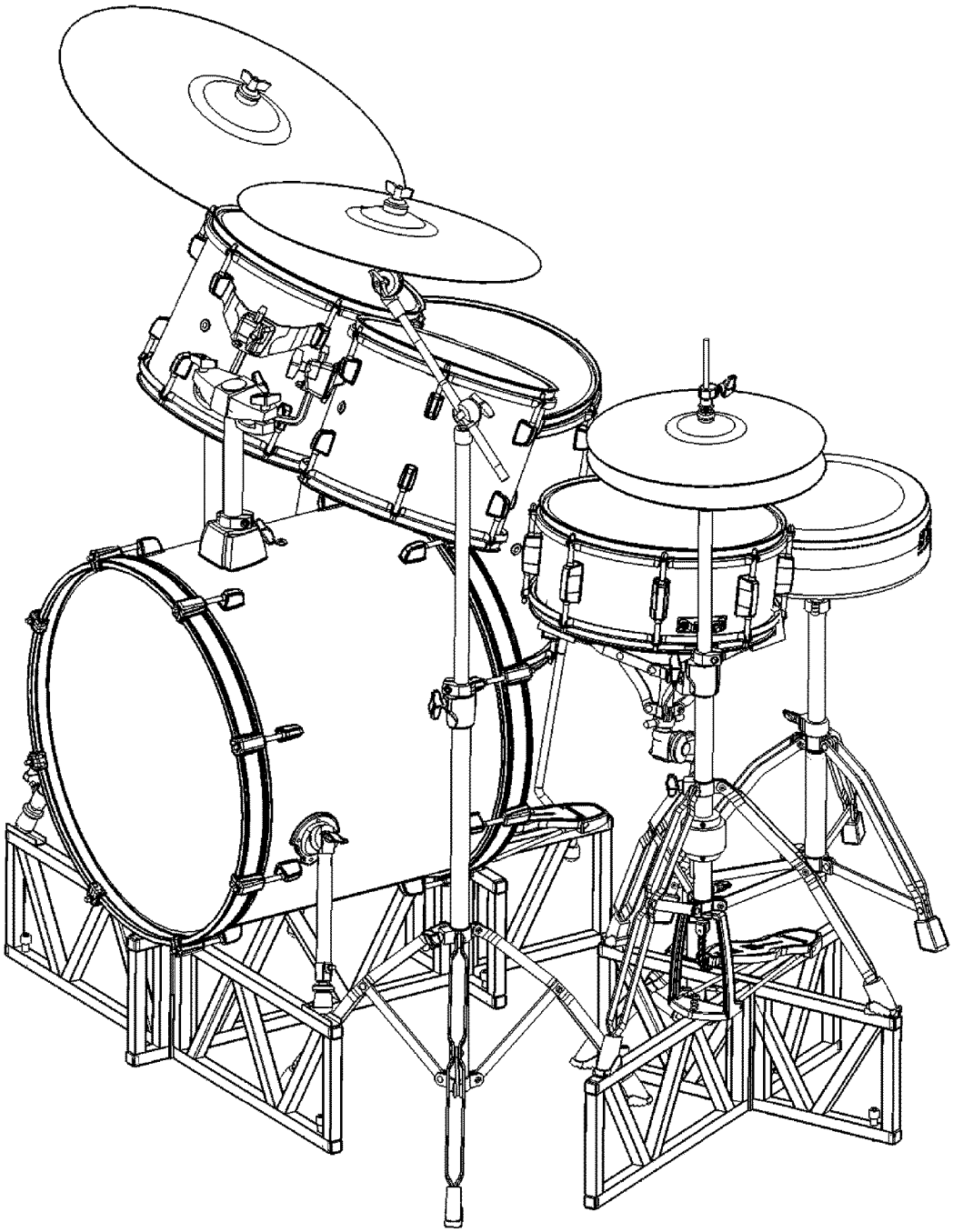
FIG. 11 is a drawing showing the assembled Kit lift with a complete drum set mounted thereon ready for use by a musician.

Referring to FIGS. 7 through 9, the Kit lift is a modular apparatus. The apparatus is formed by placing the Longitudinal Kick Support on the stage and mating the Upper Mating Channel of the Latitudinal Kick Support. The Kick Pedal Stabilizer is then mated in the same way. This assembly forms the Kick Lift Assembly. The Hat Lift Assembly is assembled in the same way with the Longitudinal Hi-Hat Support mating with the Latitudinal Support. The entire assembly combined makes the Kit lift assembly. The Kick drum and Hi-Hat stand feet are then placed in the shoes on the Kick Lift and Hat Lift respectively. The components are then adjusted to the preference of the drummer. The rest of the drum kit is then assembled in the normal manner. A higher drum throne will be required and may be procured separately.

Referring to FIGS. 5 through 11, the kick drum and the hi-hat, only, are elevated which are the only continuous points of contact that the drummer has with the drums. It should be noted that a higher stool is required to elevate the drummer by the same amount as the kick and hi-hat are elevated. The inventive apparatus provides for no increase in the footprint of the drum set. The apparatus may be carried in one hand and stowed away behind the seat or in the trunk of nearly every vehicle. There are no moving parts, and the unit assembles and disassembles in seconds adding no significant time to the setup of a show.

Figure 1:
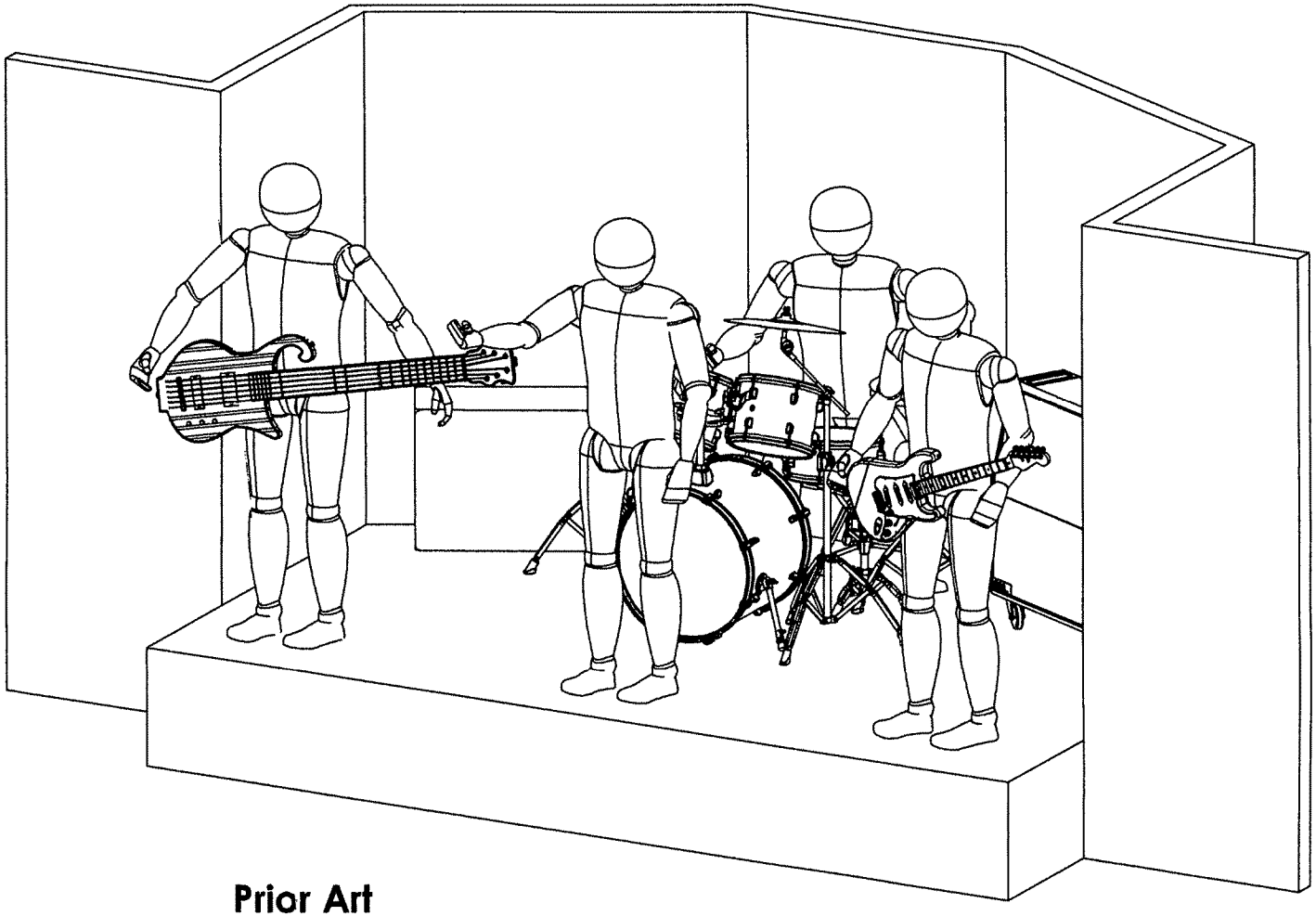
Figure 1 Prior Art
FIG. 1 is a drawing showing a front view of an audience perspective of a typical musical configuration for small venue shows. The drummer positioned in the rear is not easily visible to many in the audience.
Figure 2:
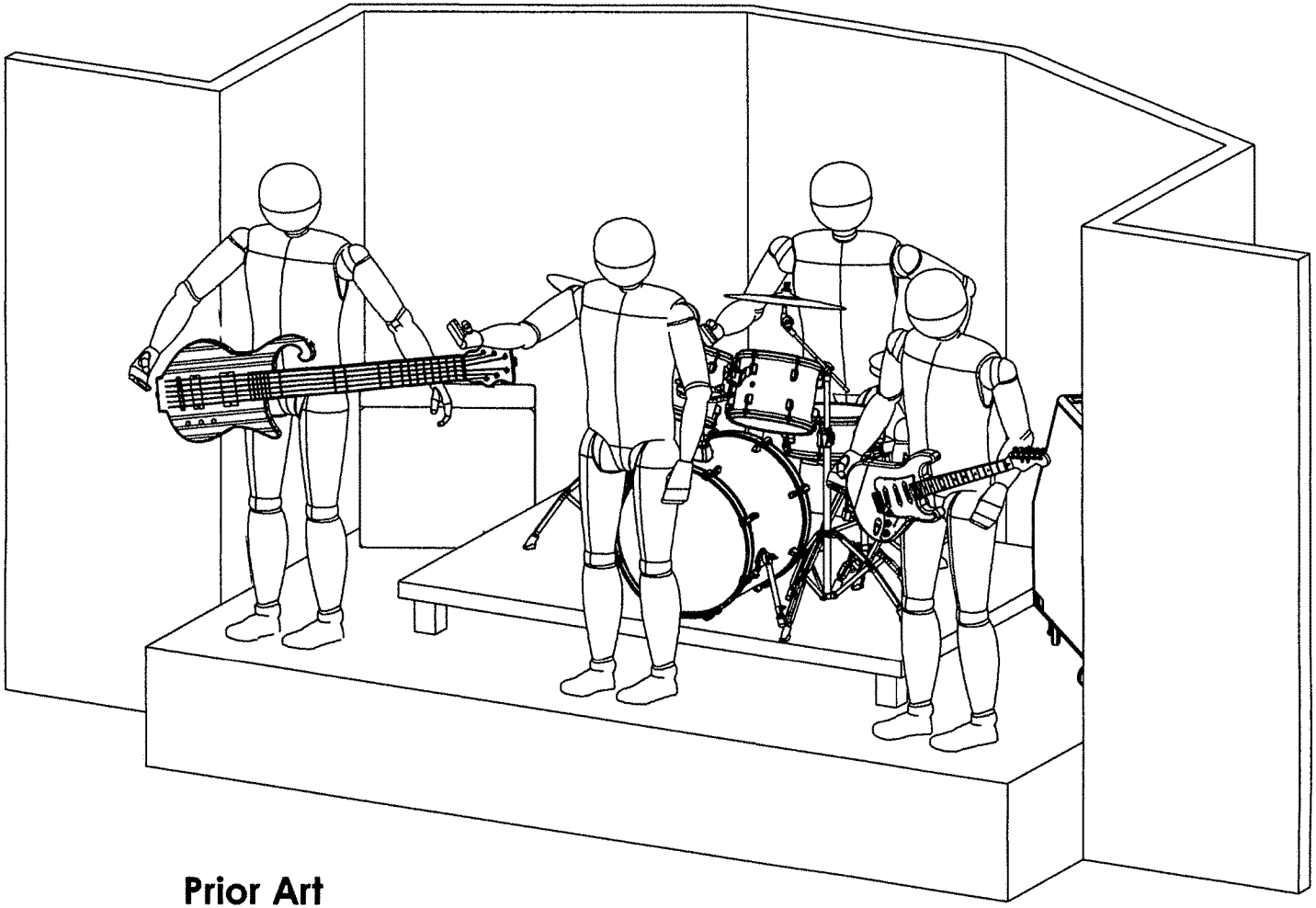
Figure 2 Prior Art
FIG. 2 is a drawing showing the same view of a typical musical configuration for small venue shows but with the drummer now performing with a typical riser. The drummer is now visible to more of the audience, but room for other performers and equipment is now limited.
Figure 3:
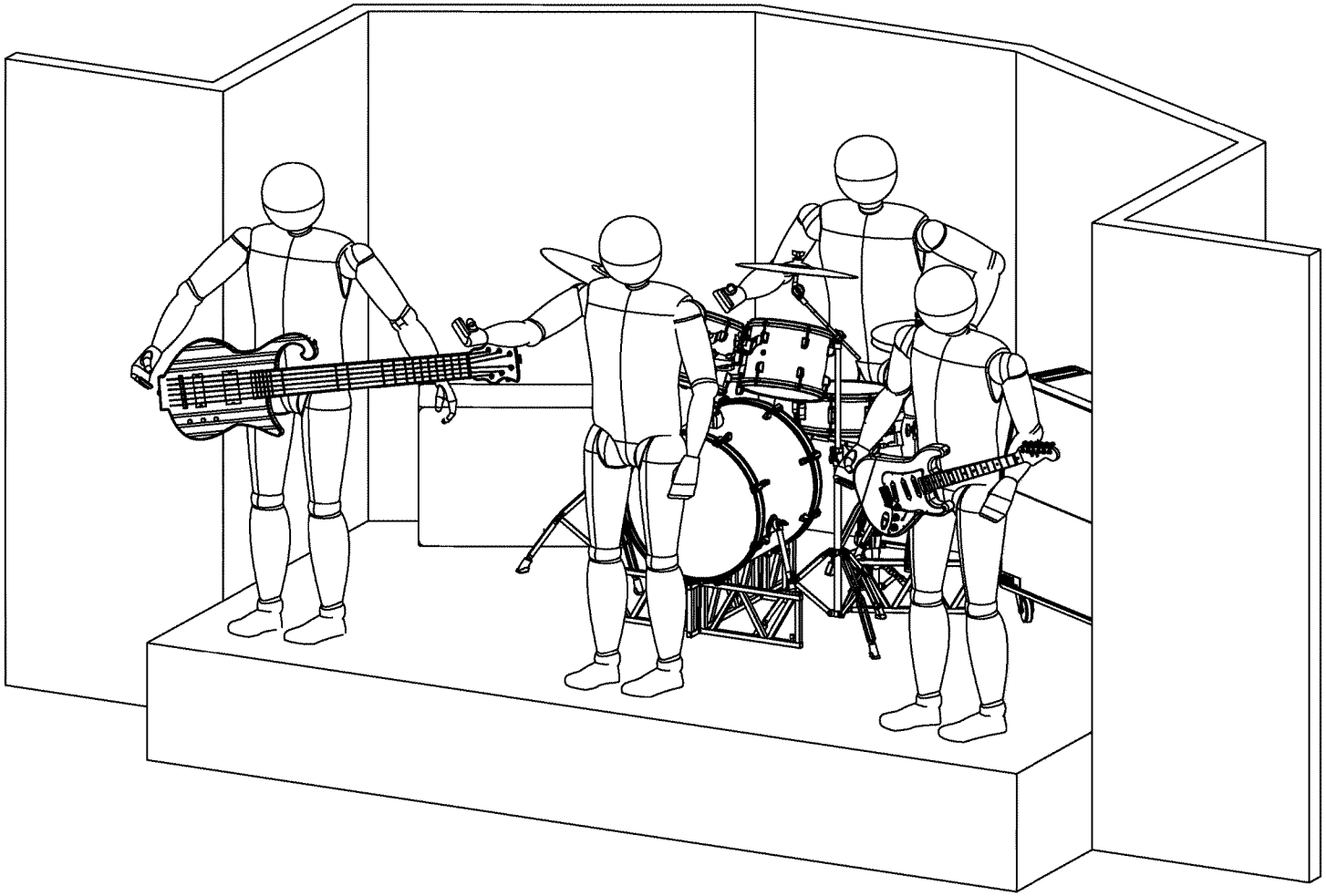
FIG. 3 is a drawing showing the same view of a typical music configuration, but with the drummer elevated by the Kit Lift rather than the traditional riser. Note that the same benefit of visibility is enjoyed without the larger drum riser.
Figure 4:
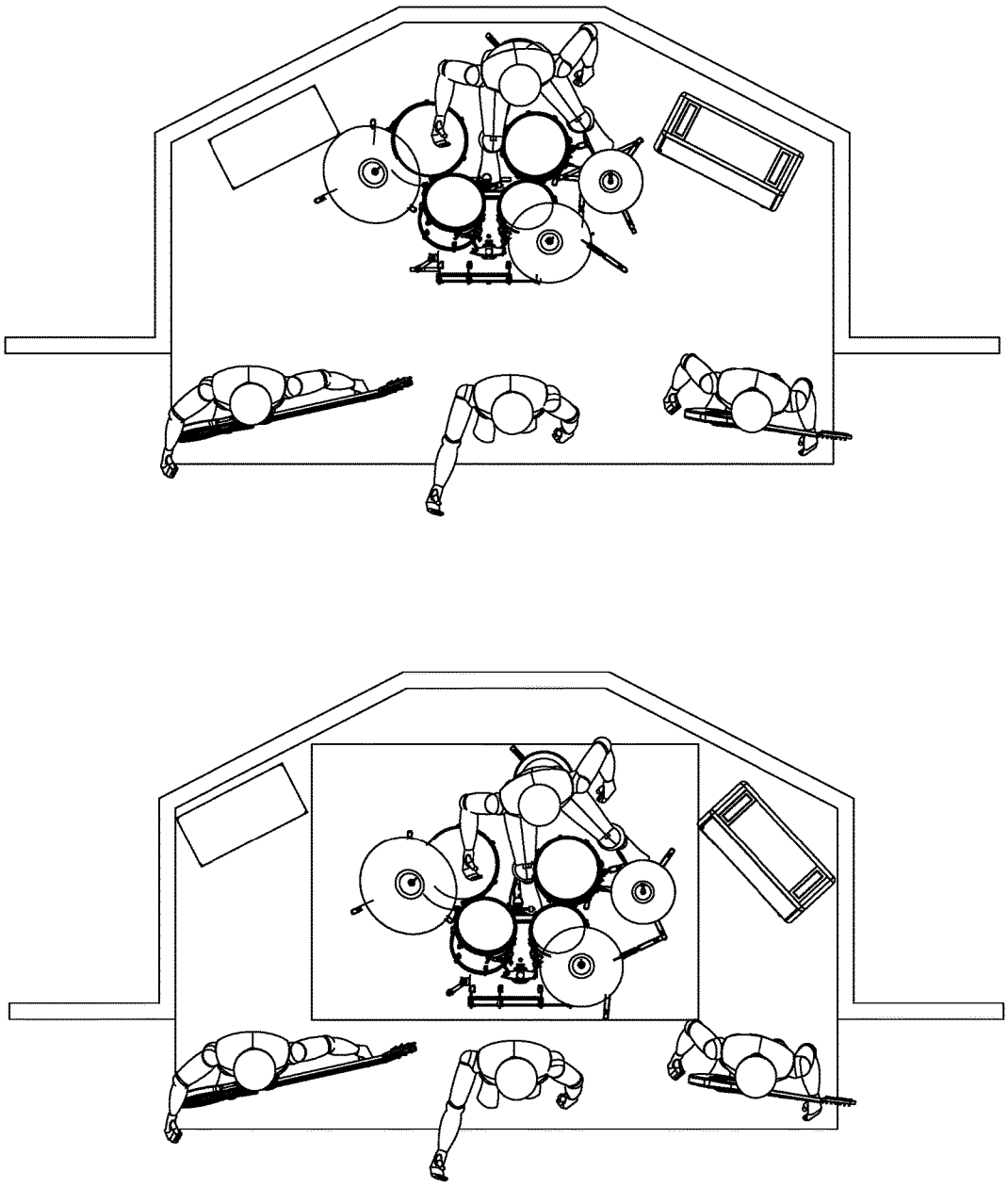
FIG. 4 is a drawing showing two top plan views of the stage comparing the Kit lift (Above) with the traditional Riser (Below). The footprint of the drum set and the drummer as supported by the Kit lift are now entirely minimized and there is more room for amplifiers, other equipment and performers.
Figure 5:
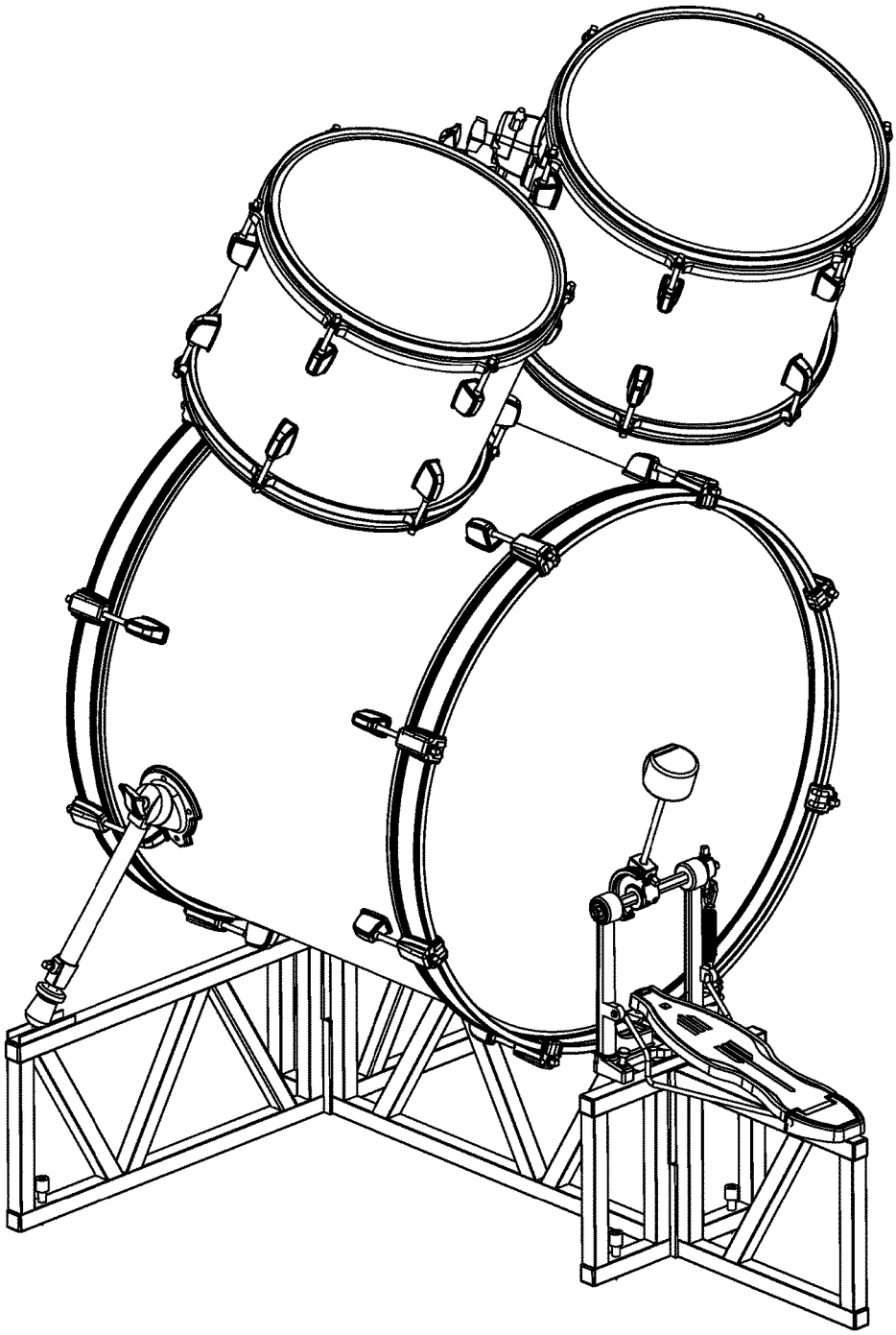
FIG. 5 is a drawing of an exemplary "Kick Lift" which elevates the kick drum only by the front supporting members and the kick pedal.
Figure 6:
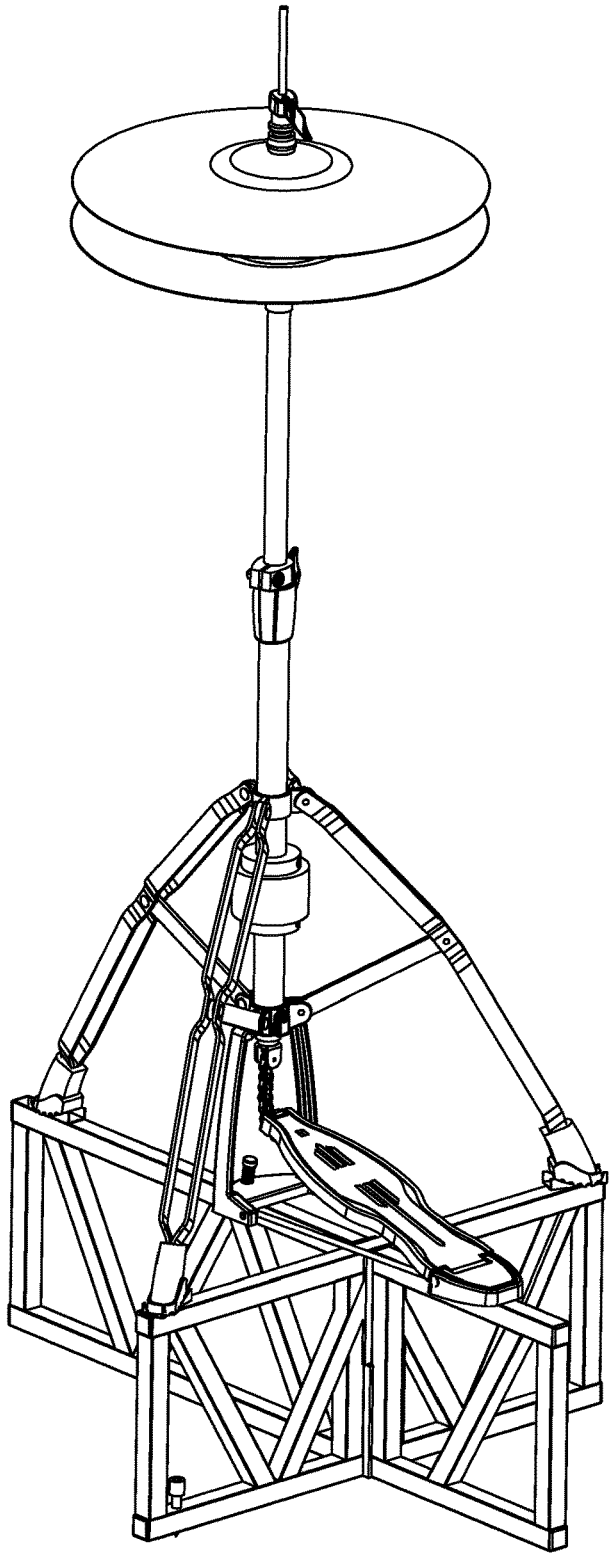
FIG. 6 is a drawing of an exemplary "Hat Lift", which elevates the entire hi-hat stand and supports the foot pedal that the drummer uses to open and close the hi-hat cymbals. The hi-hat stand is supported by custom receiver shoes that keep the hi-hat stand from slipping out of position.

Referring to FIG. 3, the Kit lift assembly provides for a stage setting that is visually exciting as it gives the appearance that the drummer is hovering above the level of the stage. Small lighting and stage effects may be clamped to the device as well for added flexibility to the show.

INDUSTRIAL APPLICABILITY

It is clear that the inventive Modular Portable Riser Apparatus of this application has wide applicability to the music industry, namely to provide easy, lightweight, small footprint elevation of both a drum set and the drummer.

It should be understood that various modifications within the scope of this invention can be made by one of ordinary skill in the art without departing from the spirit thereof and without undue experimentation. For example, the components of the Kit lift may be constructed from any suitable or desired materials. The size of the modular components may vary to accommodate different sized drum sets. Additional platform can be added to the Hat Lift to accommodate a second kick pedal for drummers to use a double pedal. This invention is therefore to be defined as broadly as the prior art will permit, and in view of the specification if need be, including a full range of current and future equivalents thereof.

The invention claimed is:

1. A modular apparatus for elevating components of a drum set, the modular apparatus comprising:

a kick lift assembly for elevating a kick drum above a floor surface, the kick lift assembly including a longitudinal kick support and a latitudinal kick support having first and second kick drum leg shoes configured to retain first and second kick drum legs therewith, wherein the latitudinal kick support is configured to couple with a first portion of the longitudinal kick support at approximately a right angle; and a hat lift assembly for elevating a hi-hat stand above the floor surface, the hat lift assembly including a longitudinal hi-hat support having a first hi-hat stand leg shoe and a latitudinal hi-hat support having second and third hi-hat leg shoes, wherein the first, second and third leg shoes are configured to retain first, second and third hi-hat stand legs therewith, and wherein the latitudinal hi-hat support is configured to couple with the longitudinal hi-hat support at approximately a right angle, wherein the modular apparatus has a travel state in which the kick lift assembly and the hat lift assembly are in a collapsed configuration, and wherein the modular apparatus has an operational state in which the kick lift assembly and the hat lift assembly are in an assembled configuration.

2. The modular apparatus of claim 1 wherein the kick lift assembly further comprises a kick pedal stabilizer configured to couple with a second portion of the longitudinal kick support at approximately a right angle.

3. The modular apparatus of claim 1 wherein the floor surface is a performance stage.

4. The modular apparatus of claim 1 wherein the kick lift assembly elevates the kick drum and the hat lift assembly elevates the hi-hat stand to a height above the floor surface.

5. The modular apparatus of claim 4 wherein the height is between 6 and 24 inches above the floor surface.

6. A portable riser apparatus for elevating drum set components above a floor surface, the portable riser apparatus comprising:

a kick lift assembly comprising— a longitudinal kick support having a first portion with a first mating channel and a second portion having a second mating channel;

a latitudinal kick support having a central portion having a third mating channel configured to engage the first mating channel when the latitudinal kick support is at a right angle to the longitudinal kick support; and a kick pedal stabilizer having a fourth mating channel configured to engage the second mating channel when the kick pedal stabilizer is at a right angle to the longitudinal kick support; and a hat lift assembly comprising— a longitudinal hi-hat stand support having a fifth mating channel; and a latitudinal hi-hat stand support having a sixth mating channel configured engage the fifth mating channel when the latitudinal hi-hat stand support is at a right angle to the longitudinal hi-hat stand support, wherein the portable riser apparatus is configured to transition between a collapsed configuration and an assembled configuration.

7. The portable riser apparatus of claim 6 wherein the latitudinal kick support includes a first shoe on an upper surface of a first portion, and includes a second shoe on the upper surface of second portion, the second portion opposite the first portion.

8. The portable riser apparatus of claim 7 wherein the kick lift assembly is configured to lift a kick drum above a floor surface by retaining a first support arm of a kick drum in the first shoe and retaining a second support arm of a kick drum in the second shoe.

9. The portable riser apparatus of claim 6 wherein the kick pedal stabilizer and the second portion of the longitudinal kick support are configured to support a kick pedal of a kick drum above the floor surface.

10. The portable riser apparatus of claim 6 wherein the kick lift assembly elevates a kick drum and the hat lift assembly elevates a hi-hat stand to a height above the floor surface.

11. The modular apparatus of claim 10 wherein the height is between 6 and 24 inches above the floor surface.

* * * * *